US008805258B2

(12) United States Patent
Chiba

(10) Patent No.: US 8,805,258 B2
(45) Date of Patent: Aug. 12, 2014

(54) FIXING DEVICE AND IMAGE FORMING APPARATUS

(75) Inventor: Takahito Chiba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 87 days.

(21) Appl. No.: 13/561,800

(22) Filed: Jul. 30, 2012

(65) Prior Publication Data

US 2013/0243501 A1 Sep. 19, 2013

(30) Foreign Application Priority Data

Mar. 16, 2012 (JP) ..... 2012-061118

(51) Int. Cl.
*G03G 15/20* (2006.01)

(52) U.S. Cl.
USPC ..... 399/329; 399/323; 399/328

(58) Field of Classification Search
USPC ..... 399/122, 323, 329, 328; 271/312
See application file for complete search history.

(56) References Cited

U.S. PATENT DOCUMENTS

2007/0217839 A1* 9/2007 Moteki et al. ..... 399/329
2008/0219725 A1* 9/2008 Saiki ..... 399/329
2011/0026986 A1* 2/2011 Yamanaka et al. ..... 399/323
2011/0135358 A1* 6/2011 Kikuchi et al. ..... 399/329
2011/0217096 A1* 9/2011 Kikuchi et al. ..... 399/329
2011/0222874 A1* 9/2011 Yamada ..... 399/33
2011/0222934 A1* 9/2011 Hasegawa ..... 399/329

FOREIGN PATENT DOCUMENTS

JP 2011-123286 A 6/2011

* cited by examiner

*Primary Examiner* — David Gray
*Assistant Examiner* — Francis Gray
(74) *Attorney, Agent, or Firm* — Sughrue Mion, PLLC

(57) ABSTRACT

A fixing device includes an endless belt, a fixing rotating body that contacts with and separates from the belt and fixes an image formed on a recording medium nipped between the fixing rotating body and the belt while rotating in contact with the belt, a support member provided so that the belt slides on the support member during circulation, the support member supporting a load provided when the fixing rotating body is in contact with the belt so as to form a nip portion where the recording medium is nipped between the belt and the fixing rotating body, a guide member that guides the recording medium to separate the recording medium from the belt after the recording medium passes through the nip portion, and a moving unit that moves the guide member away from the belt along with separation of the fixing rotating body from the belt.

7 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-061118 filed Mar. 16, 2012.

BACKGROUND

(i) Technical Field

The present invention relates to a fixing device and an image forming apparatus.

SUMMARY

According to an aspect of the invention, there is provided a fixing device including: an endless belt; a fixing rotating body that contacts with and separates from the belt and fixes, in cooperation with the belt, an image formed on a recording medium nipped between the fixing rotating body and the belt while rotating in contact with the belt; a support member provided on an inner side of the belt so that the belt slides on the support member during circulation, the support member supporting a load provided when the fixing rotating body is in contact with the belt so as to form a nip portion where the recording medium is nipped between the belt and the fixing rotating body; a guide member opposing an outer peripheral portion of the belt on a downstream side of the nip portion in a circulating direction of the belt, the guide member guiding the recording medium to separate the recording medium from the belt after the recording medium passes through the nip portion; and a moving unit that moves the guide member away from the belt along with separation of the fixing rotating body from the belt.

BRIEF DESCRIPTION OF THE DRAWINGS

Exemplary embodiment of the present invention will be described in detail based on the following figures, wherein:

FIG. 8A is a perspective view illustrating a state in which the separation pad is located at the separating position, and FIG. 8B is a perspective view illustrating a state in which the separation pad is located at the withdrawal position.

DETAILED DESCRIPTION

Figure 1:
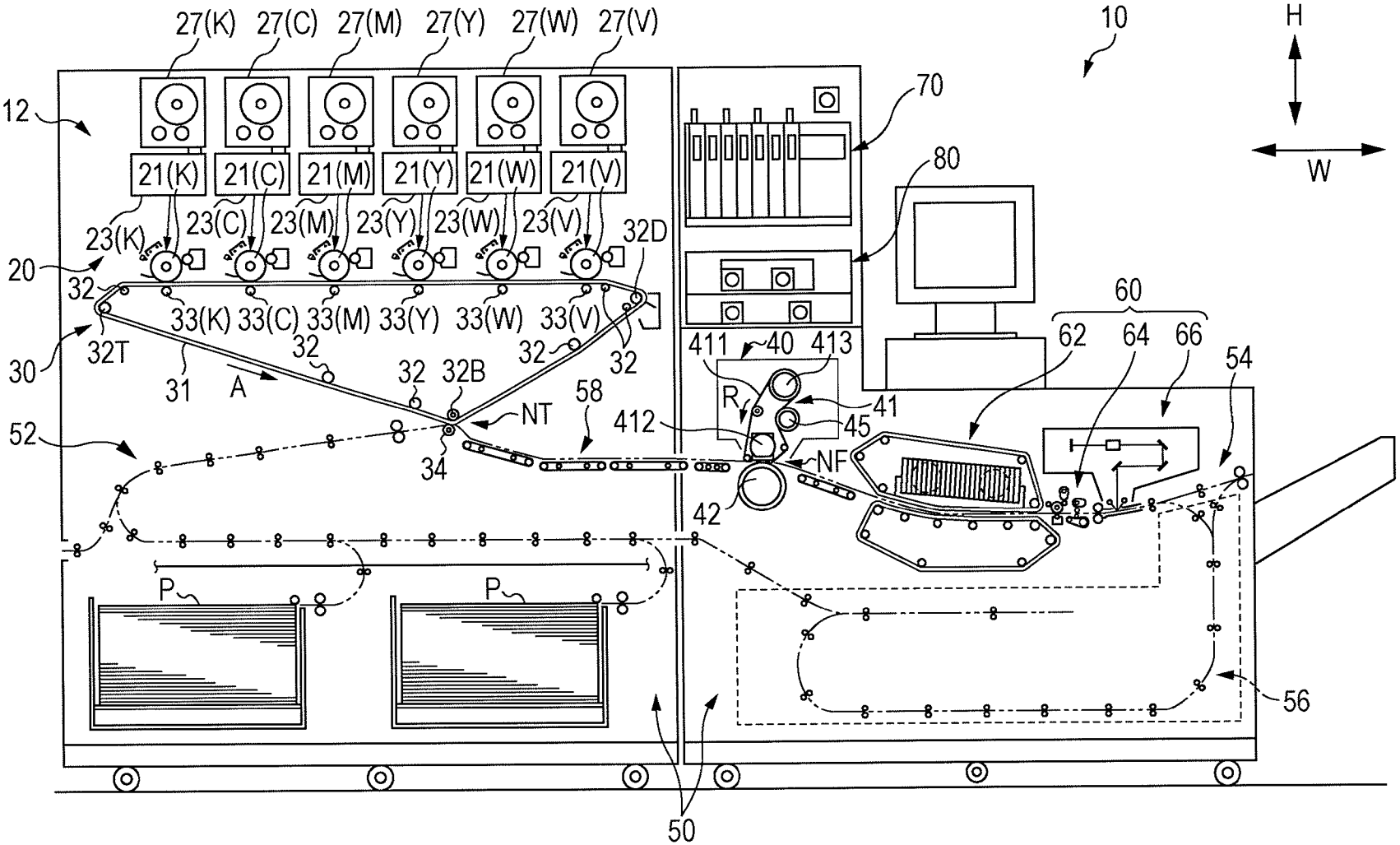
FIG. 1 schematically illustrates an overall configuration of an image forming apparatus according to an exemplary embodiment.

An exemplary embodiment of the present invention will be described below with reference to the drawings. An overall configuration and operation of an image forming apparatus will be described first, a structure and operation of a fixing device will be described next, and the principal part of the exemplary embodiment will be described after that. In the following description, a direction shown by arrow H in FIG. 1 is referred to as an apparatus height direction, and a direction shown by arrow W in FIG. 1 is referred to as an apparatus width direction. Further, a direction (appropriately shown by arrow D) orthogonal to the apparatus height direction and the apparatus width direction is referred to as an apparatus depth direction.

Overall Configuration of Image Forming Apparatus

FIG. 1 schematically illustrates an overall configuration of an image forming apparatus 10 according to the exemplary embodiment, as viewed from a front side. As illustrated in FIG. 1, the image forming apparatus 10 includes an image forming section 12 that forms an image on a recording medium P by electrophotography, a medium transport section 50 that transports the recording medium P, and a post handling section 60 that subjects the recording medium P with the image thereon to post handling. The image forming apparatus 10 further includes a controller 70 and a power supply section 80. The controller 70 controls the above sections and the power supply section 80, and the power supply section 80 supplies power to the sections including the controller 70.

Structure of Image Forming Section

Figure 2:
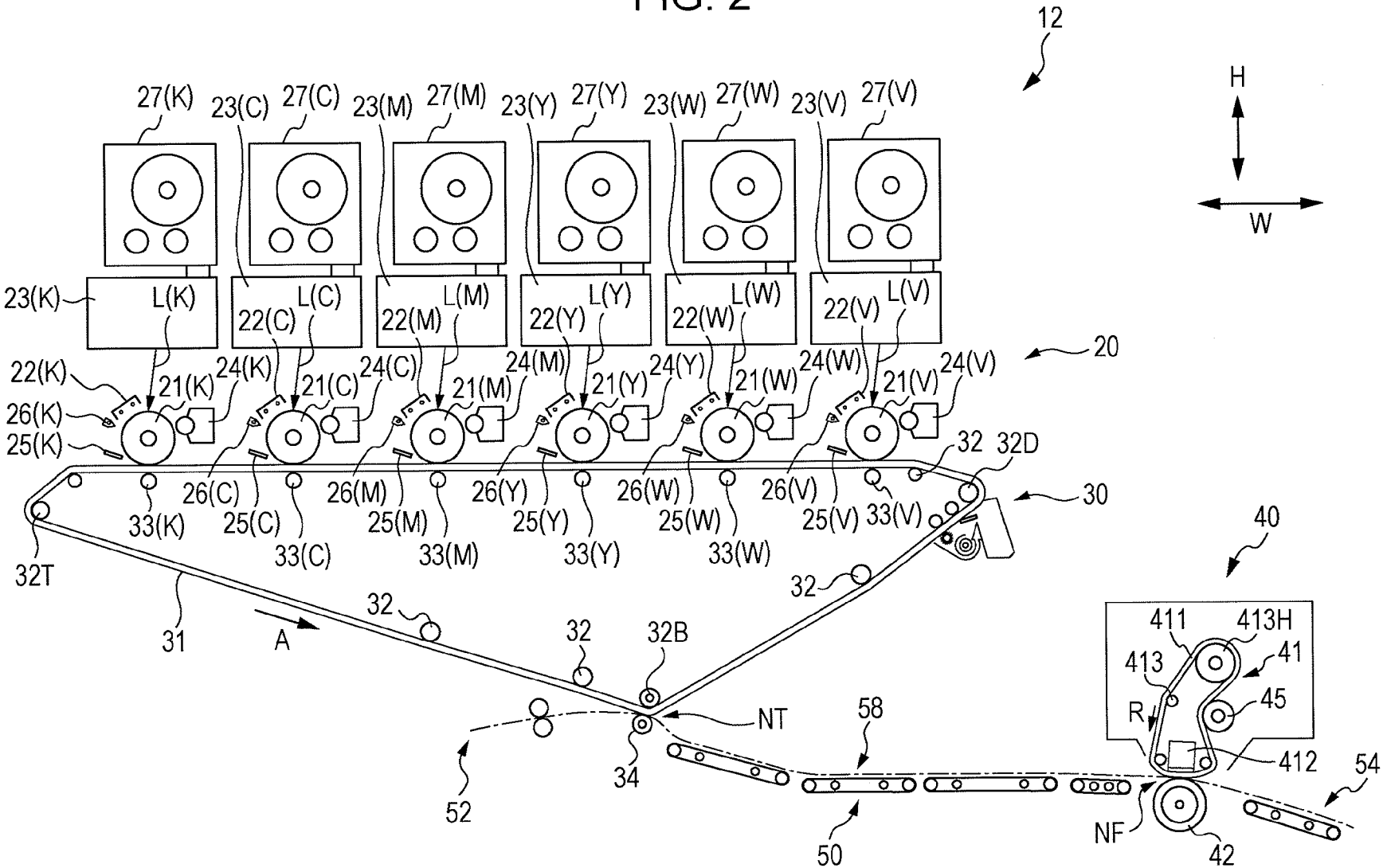
FIG. 2 schematically illustrates a structure of an image forming section that forms an image forming unit in the exemplary embodiment.

The image forming section 12 will be described with reference to FIG. 2 that schematically illustrates the image forming section 12 from the front side. The image forming section 12 includes photoconductor drums 21 serving as an example of an image carrier, chargers 22, exposure devices 23, developing devices 24, and cleaning devices 25. The image forming section 12 further includes toner-image forming units 20 that form toner images, a transfer device 30 that transfers the toner images formed by the toner-image forming units 20 onto a recording medium P, and a fixing device 40 that fixes the transferred toner images on the recording medium P.

Plural toner-image forming units 20 are provided to form toner images of different colors. In the exemplary embodiment, the toner-image forming units 20 are provided in correspondence to six colors, namely, a first special color (V), a second special color (W), yellow (Y), magenta (M), cyan (C), and black (K). In FIG. 1, (V), (W), (Y), (M), (C), and (K) represent the above colors. In the transfer device 30, toner images of six colors are first transferred and superimposed onto a transfer belt 31, and are then transferred onto a recording medium P at a transfer nip NT.

Photoconductor Drums

The photoconductor drums 21 are cylindrical, and are rotated about their axes by an unillustrated driving unit. On an outer peripheral surface of each of the photoconductor drums 21, a photosensitive layer having a negative charging polarity is provided as an example. Alternatively, an overcoat layer may be provided on the outer peripheral surface of each photoconductor drum 21. The photoconductor drums 21 for respective colors are linearly arranged in the apparatus width direction, in front view.

Chargers

The chargers 22 negatively charge outer peripheral surfaces (photosensitive layers) of the photoconductor drums 21. In the exemplary embodiment, the chargers 22 are scorotron chargers of a corona discharge type (non-contact charging type).

Exposure Devices

Figure 3:
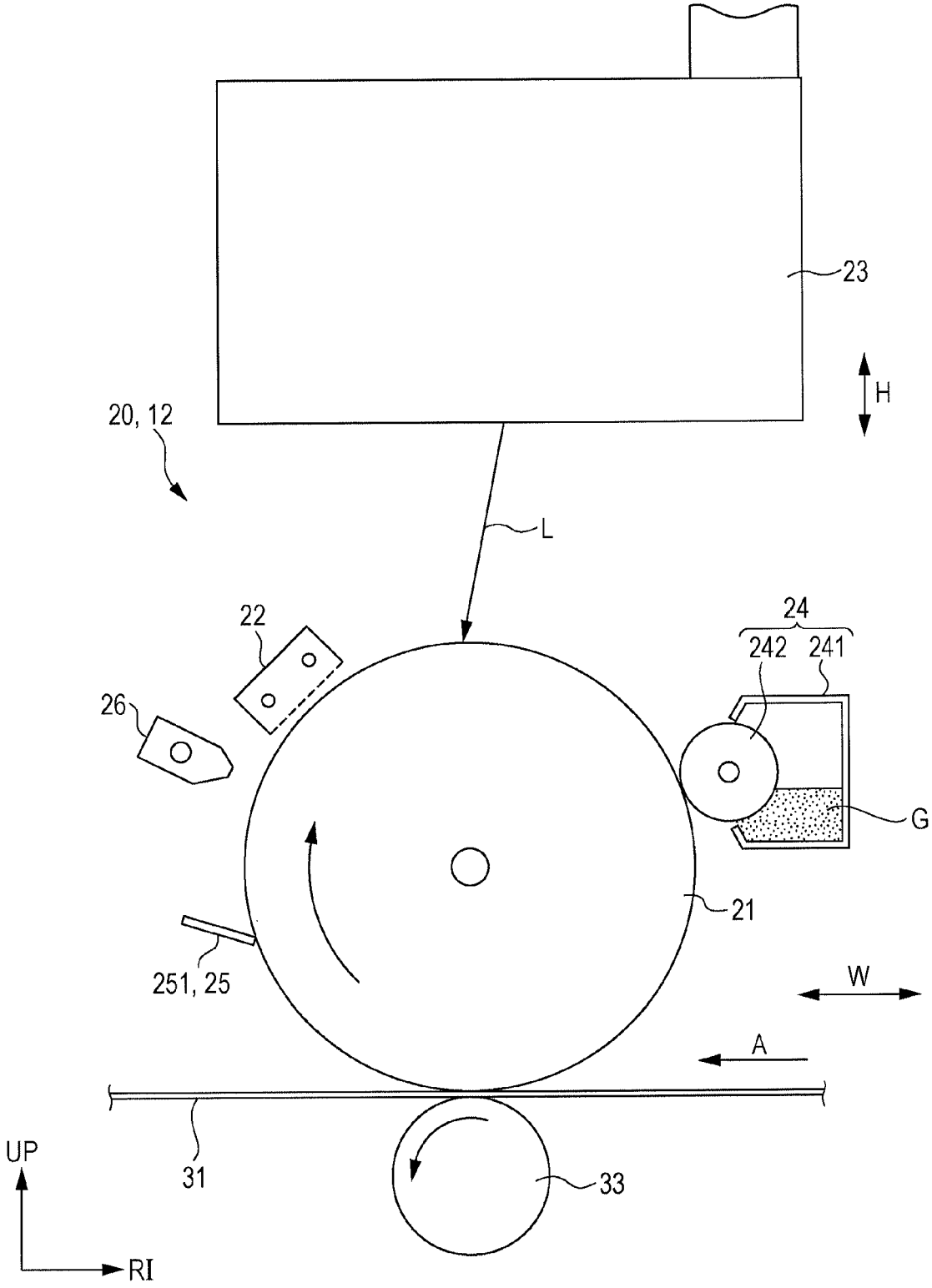
FIG. 3 schematically illustrates a structure of a toner-image forming unit that forms the image forming unit in the exemplary embodiment.

Each of the exposure devices 23 forms an electrostatic latent image on the outer peripheral surface of the corresponding photoconductor drum 21. More specifically, each exposure device 23 applies exposure light L (see FIG. 3), which is modulated according to image data received from an image signal processing unit in the controller 70, onto the outer peripheral surface of the photoconductor drum 21 charged by the corresponding charger 22. By this application of the exposure light L from the exposure device 23, an electrostatic latent image is formed on the outer peripheral surface of the photoconductor drum 21. In the exemplary embodiment, the exposure device 23 exposes the outer peripheral surface of the photoconductor drum 21 while scanning a light beam emitted from a light source with a light scanning unit (optical system) including a polygonal mirror and an fθ lens. In the exemplary embodiment, the exposure devices 23 are provided for respective colors.

Developing Devices

Each of the developing devices 24 forms a toner image on the outer peripheral surface of the corresponding photoconductor drum 21 by developing an electrostatic latent image formed on the outer peripheral surface with developer G containing toner. Although not described in detail, each developing device 24 includes at least a container 241 that contains the developer G, and a developing roller 242 that rotates to supply the developer G from the container 241 onto the photoconductor drum 21. To the container 241, a toner cartridge 27 for resupplying developer G is connected via an unillustrated resupply passage. Toner cartridges 27 for respective colors are arranged above the photoconductor drums 21 and the exposure devices 23 and in the apparatus width direction, in front view. The toner cartridges 27 can be replaced individually.

Cleaning Devices

Each of the cleaning devices 25 includes a blade 251 that scrapes off, from the surface of the corresponding photoconductor drum 21, toner remaining on the surface of the photoconductor drum 21 after a toner image is transferred to the transfer device 30. Although not illustrated, each cleaning device 25 further includes a housing in which the toner scraped off by the blade 251 is collected, and a transport device that transports the toner in the housing into a waste toner box.

Transfer Device

The transfer device 30 first-transfers and superimposes color toner images on the photoconductor drums 21 onto the transfer belt 31, and second-transfers the superimposed toner images onto a recording medium P.

More specifically, the transfer belt 31 is endless, and is wound around plural rollers 32 to determine its posture. In the exemplary embodiment, the transfer belt 31 has a posture shaped like an inverse obtuse triangle that is long in the apparatus width direction in front view. Of the plural rollers 32 illustrated in FIG. 2, a roller 32D functions as a driving roller that circulates the transfer belt 31 in a direction of arrow A with power from an unillustrated motor, a roller 32T functions as a tensioning roller that applies tension to the transfer belt 31, and a roller 32B functions as an opposing roller opposing a second transfer roller 34.

The transfer belt 31 is in contact with the photoconductor drums 21 from below in the above-described posture at an upper side portion extending in the apparatus width direction. Images on the photoconductor drums 21 are transferred onto the transfer belt 31 by the application of a transfer bias voltage from first transfer rollers 33. Further, the transfer belt 31 is in contact with the second transfer roller 34 at an obtuse lower vertex, thereby forming a transfer nip NT. The transfer belt 31 transfers the toner images onto a recording medium P passing through the transfer nip NT by the application of a transfer bias voltage from the second transfer roller 34.

Fixing Device

The fixing device 40 fixes the toner images transferred by the transfer device 30 onto a recording medium P. In the exemplary embodiment, the fixing device 40 fixes the toner images on the recording medium P with heat and pressure at a fixing nip NF.

Medium Transport Section

The medium transport section 50 includes a medium supply unit 52 that supplies a recording medium P to the image forming section 12, and a medium output unit 54 that outputs the recording medium P after an image is formed thereon. The medium transport section 50 further includes a medium return unit 56 used to form images on both surfaces of the recording medium P, and an intermediate transport unit 58 that transports the recording medium P from the transfer device 30 to the fixing device 40.

The medium supply unit 52 supplies recording media P one by one to the transfer nip NT in the image forming section 12 with transfer timing. The medium output unit 54 outputs a recording medium P from the apparatus after a toner image is fixed on the recording medium P by the fixing device 40. The medium return unit 56 turns a recording medium P, which has a fixed toner image on one surface, upside down and returns the recording medium P to the image forming section 12 (medium supply unit 52) in order to form an image on the other surface of the recording medium P.

Post Handling Section

The post handling section 60 includes a medium cooling unit 62 that cools a recording medium P on which an image is formed in the image forming section 12, a correction device 64 that corrects curl of the recording medium P, and an image inspection unit 66 that inspects the image formed on the recording medium P. The units that constitute the post handling section 60 are arranged in the medium output unit 54 of the medium transport section 50.

The medium cooling unit 62, the correction device 64, and the image inspection unit 66 that constitute the post handling section 60 are arranged in this order from an upstream side in an output direction of the recording medium P in the medium output unit 54, and conduct the above-described post handling operations on a recording medium P that is being in an output process in the medium output unit 54.

Image Forming Operation

A process for forming an image on a recording medium P in the image forming apparatus 10 and a post handling process will be described in summary.

Upon receiving an image formation command, the controller 70 starts the toner-image forming units 20, the transfer device 30, and the fixing device 40. Then, the photoconductor drums 21 and the developing rollers 242 are rotated and the transfer belt 31 is circulated. Also, the pressurizing roller 42 is rotated, and a fixing belt 411 is circulated. In synchronization with the above operations, the controller 70 starts the medium transport section 50.

Thus, the photoconductor drums 21 for respective colors are charged by the chargers 22 during rotation. The controller 70 further sends, to the exposure devices 23, image data subjected to image processing in the image signal processing unit. According to the image data, the exposure devices 23 emit exposure light L to expose the charged photoconductor drums 21, so that electrostatic latent images are formed on the outer peripheral surfaces of the photoconductor drums 21. The electrostatic latent images formed on the photoconductor drums 21 are developed with developer supplied from the developing devices 24, so that, on each of the photoconductor drums 21, a toner image of a corresponding color, of the first special color (V), the second special color (W), yellow (Y), magenta (M), cyan (C), and black (K), is formed.

Toner images of six colors formed on the photoconductor drums 21 are sequentially transferred onto the circulating transfer belt 31 by the application of transfer bias voltage via the first transfer rollers 33. Thus, the toner images are superimposed to form a superimposed toner image on the transfer belt 31. The superimposed toner image is transported to the transfer nip NT by circulation of the transfer belt 31. To the transfer nip NT, a recording medium P is supplied by the medium supply unit 52 in synchronization with transport of the superimposed toner image. When a transfer bias voltage is applied at the transfer nip NT, the superimposed toner image is transferred from the transfer belt 31 onto the recording medium P.

The recording medium P on which the toner image is transferred is transported from the transfer nip NT in the transfer device 30 toward the fixing nip NF in the fixing device 40 by the intermediate transport unit 58 while being attracted by a negative pressure. The fixing device 40 applies heat and pressure (fixing energy) to the recording medium P passing through the fixing nip NF. Thus, the transferred toner image is fixed on the recording medium P.

The recording medium P output from the fixing device 40 is handled by the post handling section 60 while being transported toward an output medium receiving portion provided outside the apparatus by the medium output unit 54. The recording medium P heated in the fixing process is first cooled by the medium cooling unit 62. Next, the recording medium P is corrected for curl by the correction device 64. Further, the toner image fixed on the recording medium P is inspected by the image inspection unit 66 to detect the presence or absence and degree of a toner concentration defect, an image defect, an image position defect, etc. Then, the recording medium P is output to the medium output unit 54.

To form an image on a no-image surface of a recording medium P on which an image is not formed (double-sided printing), the controller 70 switches the transport path of the recording medium P, which has passed through the image inspection unit 66, from the medium output unit 54 to the medium return unit 56. The recording medium P is thereby turned upside down, and is sent into the medium supply unit 52. On a back surface of the recording medium P, an image is formed (fixed) in a process similar to the image forming process for forming an image on the front surface. Then, the recording medium P is output from the apparatus by the medium output unit 54 through a process similar to the post handling process performed after image formation on the front surface.

Basic Structure of Fixing Device

Figure 4:
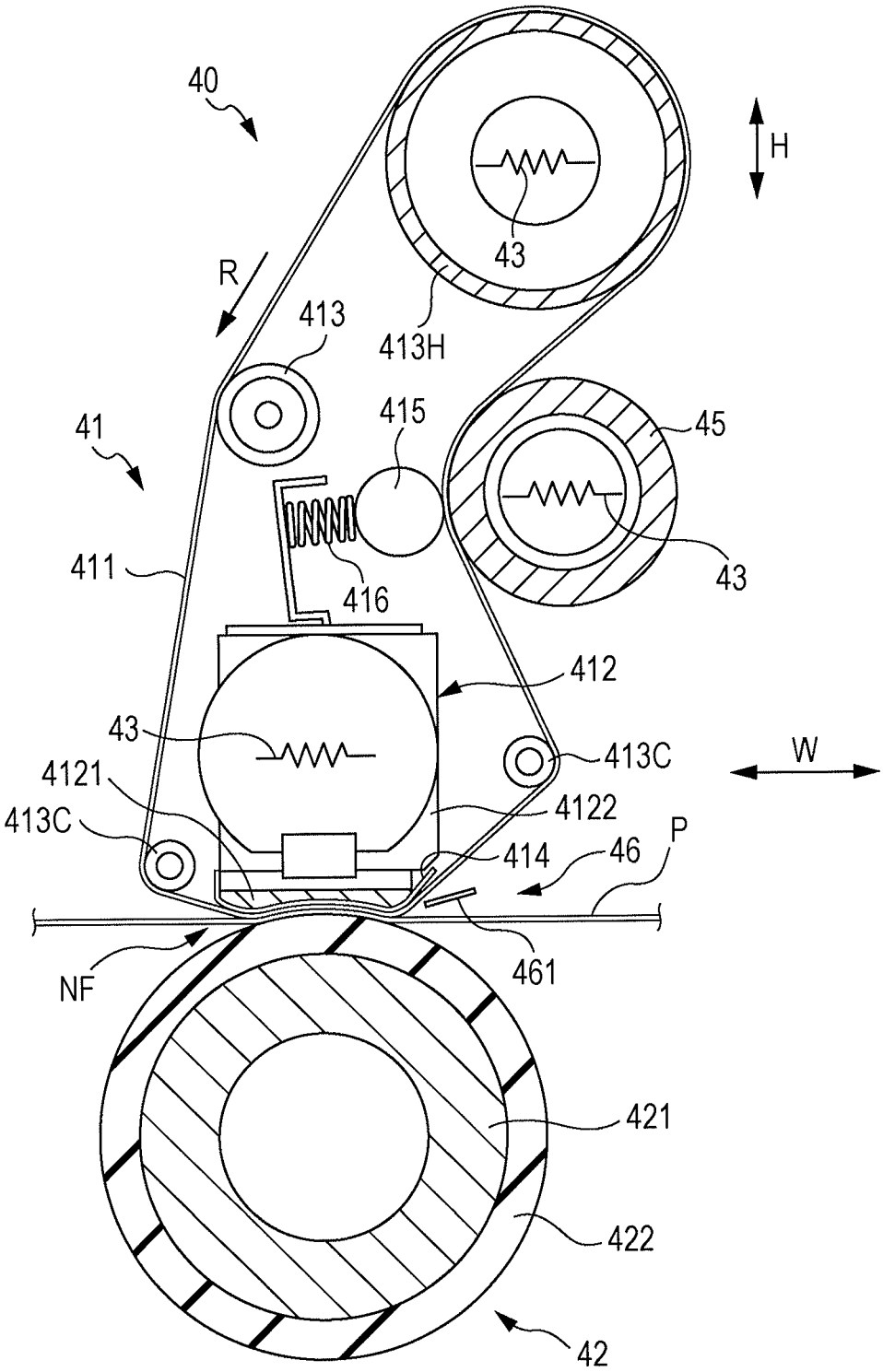
FIG. 4 is a schematic cross-sectional view illustrating a structure of a fixing device according to the exemplary embodiment.

FIG. 4 is a schematic cross-sectional view illustrating the principal part of the fixing device 40 that performs a fixing operation. As illustrated in FIG. 4, the fixing device 40 includes a fixing belt module 41, an external roller 45 on which the fixing belt module 41 is wound from the outer side, and a pressurizing roller 42 that forms the fixing nip NF with the fixing belt module 41. The fixing device 40 further includes halogen lamps 43 that heat the fixing belt module 41, and a separation pad mechanism 46 that separates a leading edge of a recording medium P from the fixing belt module 41 after the recording medium P passes through the fixing nip NF.

The fixing belt module 41 includes a fixing belt 411, a pad member 412 that extends long in the apparatus depth direction, and plural rollers 413 having rotation axes extending in the apparatus depth direction. The fixing belt 411 is shaped like a ring (is endless) opening at both sides in the apparatus depth direction orthogonal to the transport direction of the recording medium P. The fixing belt 411 is wound on the pad member 412, the rollers 413, and the external roller 45 so that the posture thereof is determined. While maintaining the posture, the fixing belt 411 circulates in a direction of arrow R in FIG. 4 (on a circulation path along the posture).

The pad member 412 is provided on an inner side of the fixing belt 411, and forms the fixing nip NF between the fixing belt 411 and the pressurizing roller 42 by receiving a press (nip) load from the pressurizing roller 42 on a nip forming surface 4121. The pad member 412 is fixed to an apparatus frame, and does not follow circulation of the fixing belt 411.

The nip forming surface 4121 of the pad member 412 is curved to be concave in an arc form to the pressurizing roller 42, as viewed in the apparatus depth direction. Because of this shape, the fixing nip NF formed between the fixing belt 411 and the pressurizing roller 42 is longer in the transport direction of the recording medium P, than in a structure in which a roller for supporting the nip load is provided instead of the pad member 412.

A slide sheet 414 is interposed between the fixing belt 411 and the nip forming surface 4121 of the pad member 412. At least a surface of the slide sheet 414 in contact with the fixing belt 411 is formed of a low-friction material such as fluororesin. This reduces the frictional resistance to circulation of the fixing belt 411.

In a body portion 4122 of the pad member 412, a halogen lamp 43 is provided as an example of a heat source. The pad member 412 also functions as a heat transfer member that transfers heat generated by the halogen lamp 43 to the fixing belt 411 via the nip forming surface 4121.

Rollers 413C provided on upstream and downstream sides of the pad member 412 in the circulating direction of the fixing belt 411, of the plural rollers 413, function as posture correction rollers. More specifically, the rollers 413C suppress the change of the fixing belt 411 in the circulating direction on the upstream and downstream sides of the fixing nip NF (bend the fixing belt 411 at an obtuse angle on the upstream and downstream sides of the fixing nip NF).

A roller 413H farthest from the pad member 412, of the rollers 413, functions as an internal heating roller that heats the fixing belt 411 from the inner peripheral side. More specifically, the fixing belt 411 is wound on the roller 413H from the inner peripheral side, and the roller 413H transfers, to the fixing belt 411, heat generated by a halogen lamp 43 provided therein. In the exemplary embodiment, the roller 413H also functions as a steering roller that can adjust the position of the fixing belt 411 in a width direction (apparatus depth direction) by tilting an axis of the roller 413H with respect to the apparatus depth direction.

For example, the pressurizing roller 42 is formed by covering an outer periphery of a cylindrical roller body 421 of aluminum with an elastic layer 422 of silicone rubber. Although not illustrated, an outer periphery of the elastic layer 422 is provided with a separation layer having a thickness of 100 μm and formed of fluororesin or the like. The pressurizing roller 42 functions as a driving roller that is rotated by an unillustrated driving source to apply driving force for circulation to the fixing belt 411.

The fixing device 40 further includes the external roller 45 on which the fixing belt 411 is wound from the outer peripheral side. The external roller 45 is provided between the roller 413C on the downstream side of the pad member 412 in the circulating direction of the fixing belt 411 and the roller 413H. The external roller 45 functions as an external heating roller that heats the fixing belt 411 from the outer peripheral side. More specifically, the external roller 45 transfers, to the fixing belt 411, heat generated by a halogen lamp 43 provided therein. Also, the external roller 45 functions as a driving roller that is rotated by an unillustrated driving source to apply a driving force for circulation to the fixing belt 411. In the exemplary embodiment, the pressurizing roller 42 serves as a main driving roller for mainly applying driving force to the fixing belt 411, and the external roller 45 serves as an auxiliary driving roller.

The fixing belt module 41 further includes a pressing roller 415 for pressing the fixing belt 411 against the external roller 45 from the inner peripheral side. The pressing roller 415 presses the fixing belt 411 against the external roller 45 with a load determined by biasing of a spring 416. In this structure, a frictional force that contributes to transmission of the driving force from the external roller 45 to the fixing belt 411 is more than in a structure in which the pressing roller 415 is not provided.

The separation pad mechanism 46 includes a separation pad 461 provided on the downstream side of the fixing nip NF in the transport direction of the recording medium P, and a distal end of the separation pad 461 is provided close to the fixing nip NF.

Although not illustrated, the fixing belt module 41 is detachably mounted in the apparatus frame as an integral module including the fixing belt 411, the pad member 412, and the rollers 413.

Basic Operation of Fixing Device

Prior to an operation of the image forming section 12 for forming (transferring) an image on a recording medium P, the fixing device 40 prepares for operation in response to a command from the controller 70. More specifically, the pressurizing roller 42 and the external roller 45 are driven to circulate the fixing belt 411 along a predetermined path. Further, the temperature of the fixing belt 411 is increased into a predetermined temperature range by heating of the halogen lamps 43, and is kept in the temperature range. The temperatures of portions of the fixing belt 411 are kept within the predetermined range because the fixing belt 411 is heated while circulating.

When a recording medium P, on which a toner image is transferred by the transfer device 30, is guided into the fixing nip NF by the intermediate transport unit 58, as illustrated in FIG. 4, the fixing device 40 applies pressure and heat (fixing energy) to the recording medium P while transporting the recording medium P, so that the toner image is fixed on the recording medium P.

Then, a leading edge of the recording medium P passing through the fixing nip NF enters between the separation pad 461 of the separation pad mechanism 46 and the pressurizing roller 42. More specifically, the fixing belt 411 circulates along a round shape provided at an end of the nip forming surface 4121 of the pad member 412 on the downstream side in the transport direction of the recording medium P (and a circulation path formed between the round shape and the downstream roller 413C) and separates from the transport path of the recording medium P. Thus, the leading edge of the recording medium P separates from the fixing belt 411 (does not follow circulation of the fixing belt 411) because of its stiffness (restorability), and enters between the separation pad 461 of the separation pad mechanism 46 and the pressurizing roller 42. The recording medium P separates from the fixing belt 411 as it is transported. The recording medium P thus output from the fixing device 40 is transported to the downstream side (toward the post handling section 60) by the medium output unit 54.

Principal Structure of Fixing Device

Position Switch Mechanism for Pressurizing Roller

In the fixing device 40 having the above-described structure, the pressurizing roller 42 can contact with and separate from the fixing belt module 41. More specifically, the position of the pressurizing roller 42 is switched between a contact position of FIG. 5 where the pressurizing roller 42 is in contact with the fixing belt 411 serving as an example of a belt to form the fixing nip NF and a separate position of FIG. 6 where the pressurizing roller 42 is separate from the fixing belt 411. This structure will be described specifically.

The fixing device 40 includes a device frame 47. The device frame 47 includes a fixed frame 471 and a movable frame 472 movable relative to the fixed frame 471. In the exemplary embodiment, the movable frame 472 is turnable relative to the fixed frame 471 about a support shaft 473 whose axial direction is the apparatus depth direction.

The fixed frame 471 fixes and supports the pad member 412 serving as an example of a support member in the fixing belt module 41, and supports the rollers 413 rotatably about their axes. Thus, the fixing belt module 41 does not move relative to the fixed frame 471 except in circulation of the fixing belt 411 and rotation of the rollers 413.

In contrast, the pressurizing roller 42 serving as an example of a fixing rotating body is rotatably supported by the movable frame 472. The position of the pressurizing roller 42 is switched between the contact position of FIG. 5 and the separate position of FIG. 6 when the movable frame 472 turns relative to the fixed frame 471 about the support shaft 473. More specifically, the movable frame 472 includes a load input portion 4721 provided on a side of the pressurizing roller 42 opposite the support shaft 473 in the apparatus width direction. By applying an upward load to the load input portion 4721, the pressurizing roller 42 is held at the contact position. The holding load is supported by the fixed frame 471 via the pad member 412. When the upward load is removed from the load input portion 4721, the pressurizing roller 42 turns downward about the support shaft 473 along with the movable frame 472 because of its own weight, and is moved to the separate position. Alternatively, the pressurizing roller 42 may be moved to the separate position by a restoring force of an unillustrated elastic member.

The fixing device 40 further includes a switch mechanism 48 that switches the position of the pressurizing roller 42 between the contact position and the separate position. The switch mechanism 48 switches between a state for applying an upward load to the load input portion 4721 of the movable frame 472 and a state for removing the load. The switch mechanism 48 will be specifically described below.

The switch mechanism 48 includes a pressing arm 481. The pressing arm 481 is supported turnably about the support shaft 473 with the movable frame 472 relative to the fixed frame 471. A distal end 4811 of the pressing arm 481 is provided below the load input portion 4721 of the movable frame 472, and a compression coil spring 482 is interposed between the distal end 4811 and the load input portion 4721.

An inner ring of a bearing 483 functioning as a cam follower is fixed to a portion of the pressing arm 481 between the support shaft 473 and the compression coil spring 482. The switch mechanism 48 further includes a cam 484 that supports the pressing arm 481 from below while being in contact with an outer ring of the bearing 483. The cam 484 is supported by the fixed frame 471 to be turned by an unillustrated motor.

Figure 5:
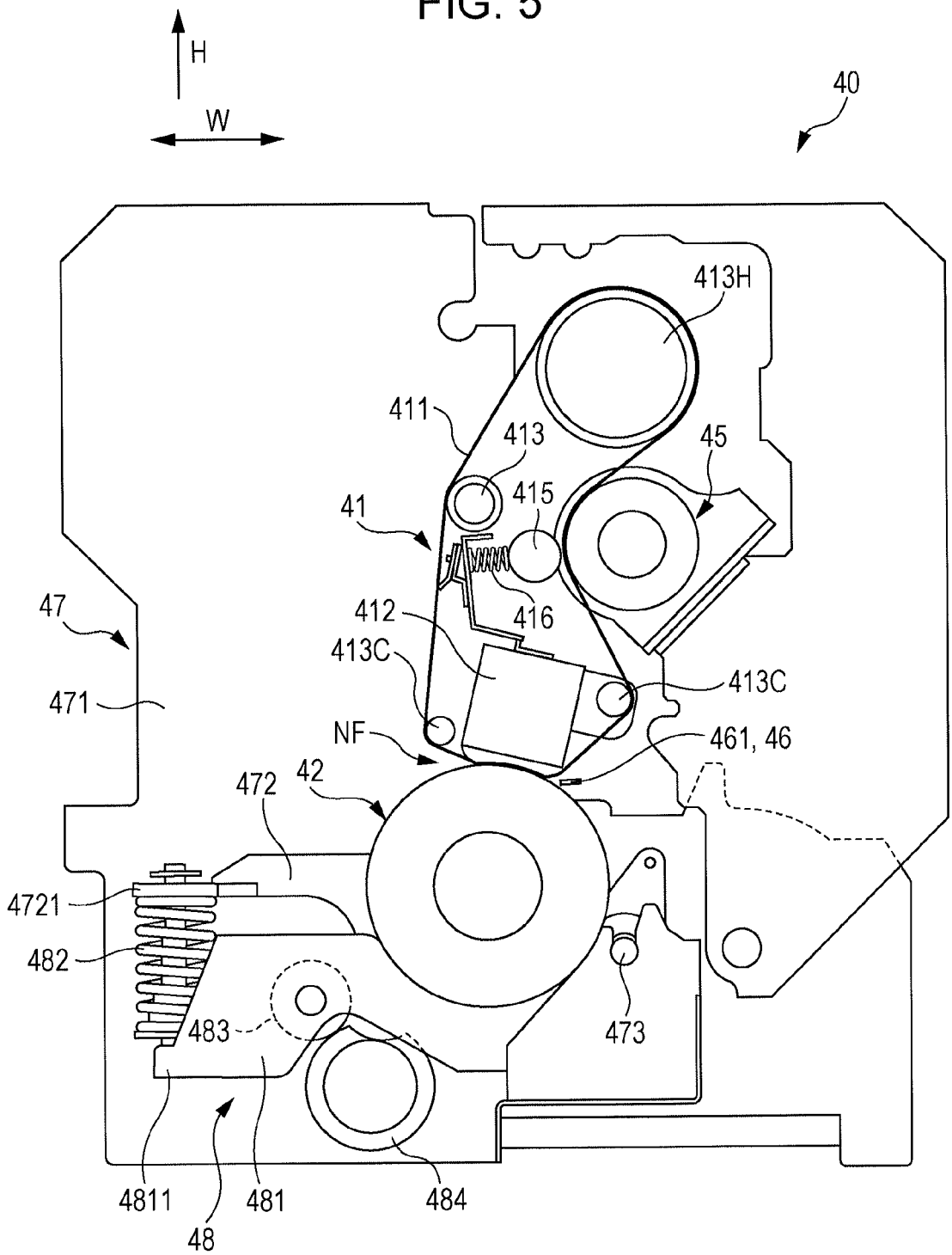
FIG. 5 schematically illustrates a state in which a pressurizing roller is brought into contact with a fixing belt by a position switch mechanism in the fixing device of the exemplary embodiment.

In a state in which a long-diameter portion of the cam 484 is in contact with the outer ring of the bearing 483, as illustrated in FIG. 5, the pressing arm 481 is in a substantially horizontal position, and the pressurizing roller 42 is placed at the contact position. In this state, an upward load corresponding to the compression amount of the compression coil spring 482 is applied to the load input portion 4721 of the movable frame 472. That is, the pressurizing roller 42 is in contact with the fixing belt 411 with a nip pressure within a predetermined range.

Figure 6:
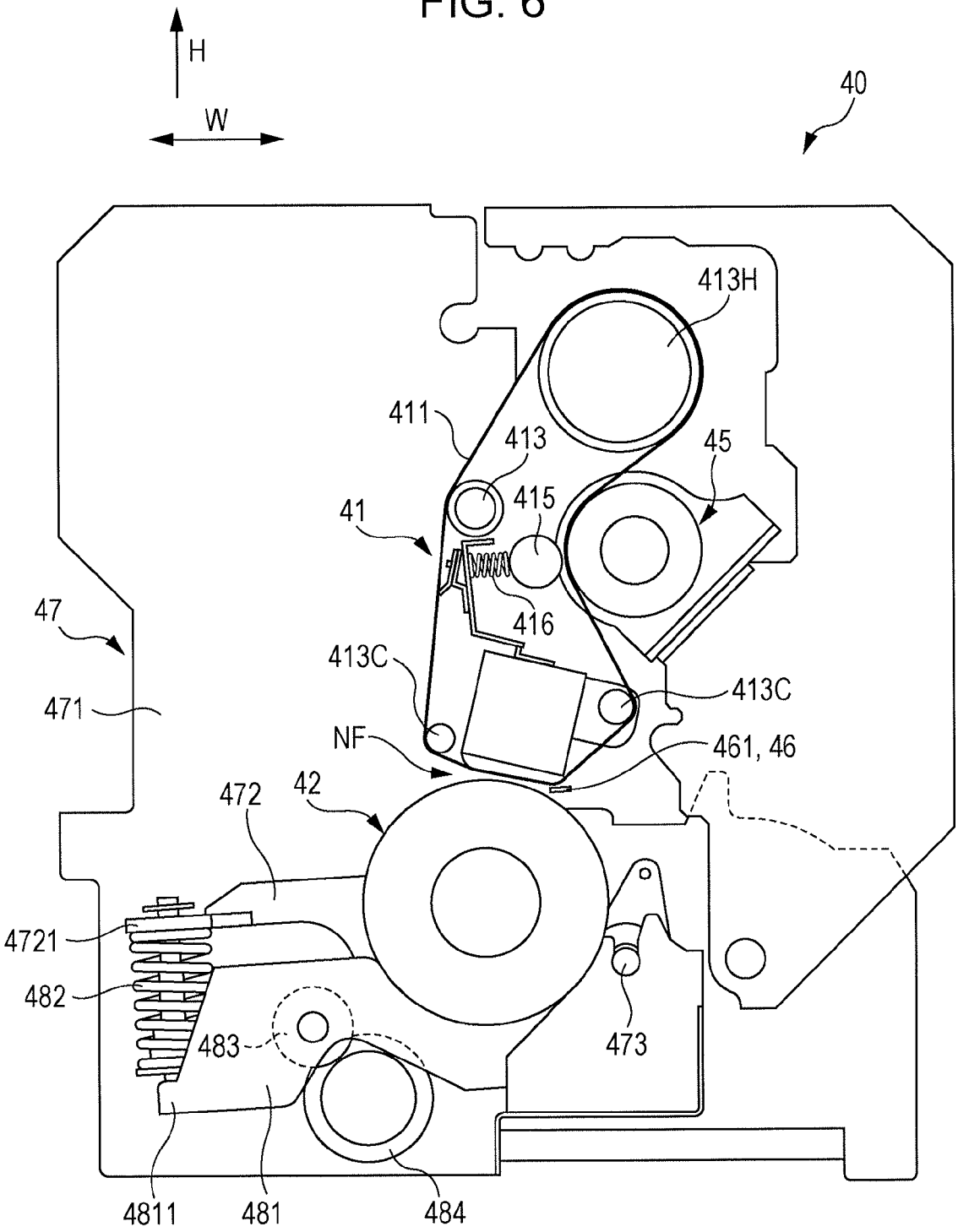
FIG. 6 schematically illustrates a state in which the pressurizing roller is separated from the fixing belt by the position switch mechanism in the fixing device of the exemplary embodiment.

In contrast, in a state in which a short-diameter portion of the cam 484 is in contact with the outer ring of the bearing 483, as illustrated in FIG. 6, the pressing arm 481 is tilted with the distal end 4811 being lowered, and expansion of the compression coil spring 482 is limited by an unillustrated stopper. For this reason, the pressurizing roller 42 is separated from the fixing belt 411 by its own weight, and the upward load is removed from the load input portion 4721 of the movable frame 472. In this state, the pressurizing roller 42 and the movable frame 472 are held at the separate position (lower moving limit) via the pressing arm 481 and the cam 484.

Summarizing the above, in the fixing device 40, the position of the pressurizing roller 42 relative to the fixing belt 411 is selectively switched between the contact position and the separate position according to the turn position of the cam 484 in the switch mechanism 48. In the exemplary embodiment, for example, at the stop of the image forming apparatus 10 and during a warm-up of the fixing device 40, the pressurizing roller 42 is placed at the separate position under the control of the controller 70.

Contact and Separation Mechanism for Separation Pad

Figure 7B:
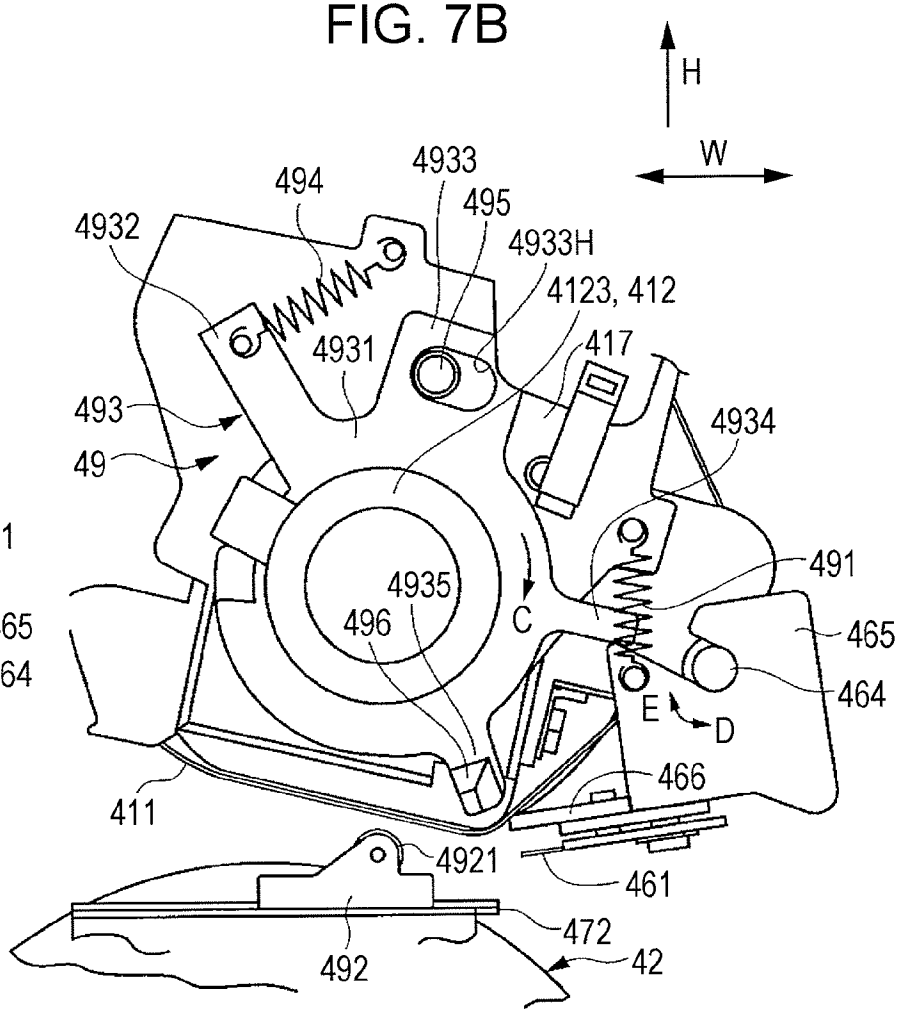
FIGS. 7A and 7B illustrate a separation pad that forms the fixing device of the exemplary embodiment, FIG. 7A schematically illustrates a state in which the separation pad is located at a separating position, and FIG. 7B schematically illustrates a state in which the separation pad is located at a withdrawal position.
Figure 7A:
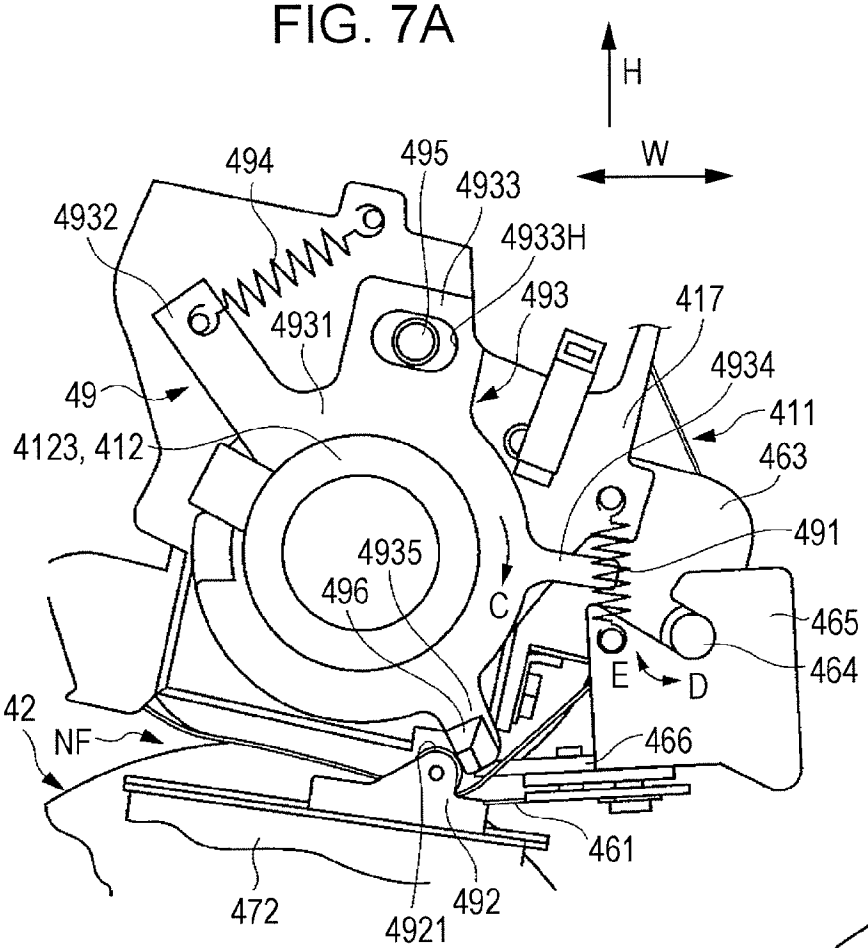
Figure 8A:
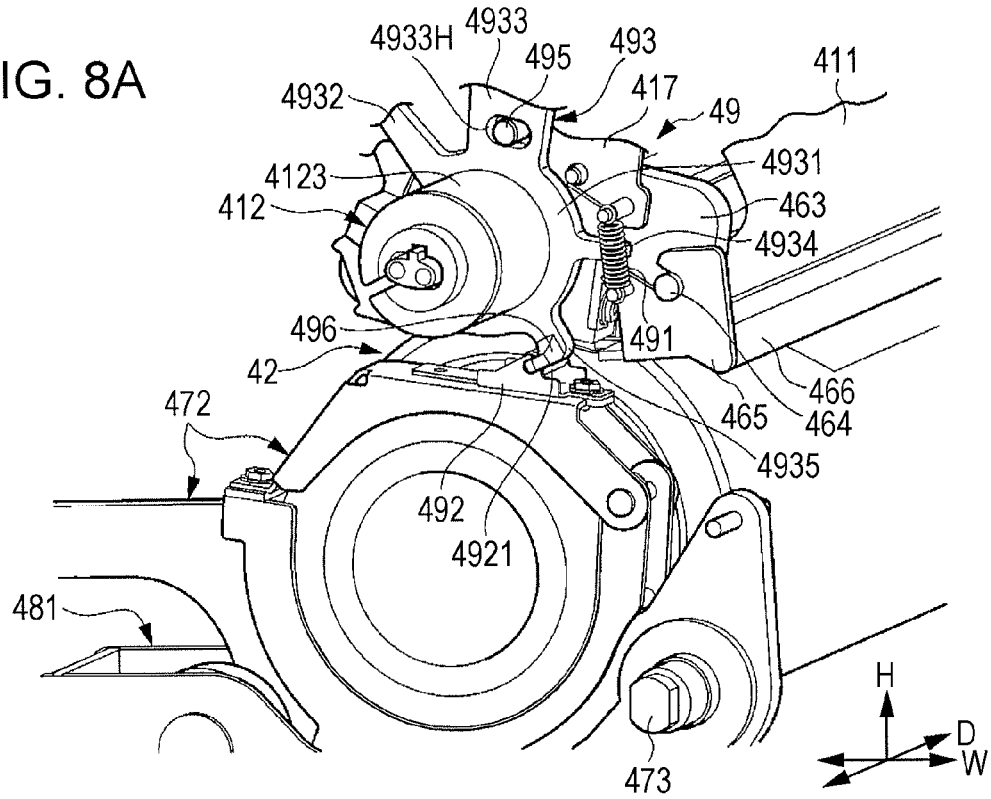
FIGS. 8A and 8B illustrate the separation pad that forms the fixing device of the exemplary embodiment.
Figure 8B:
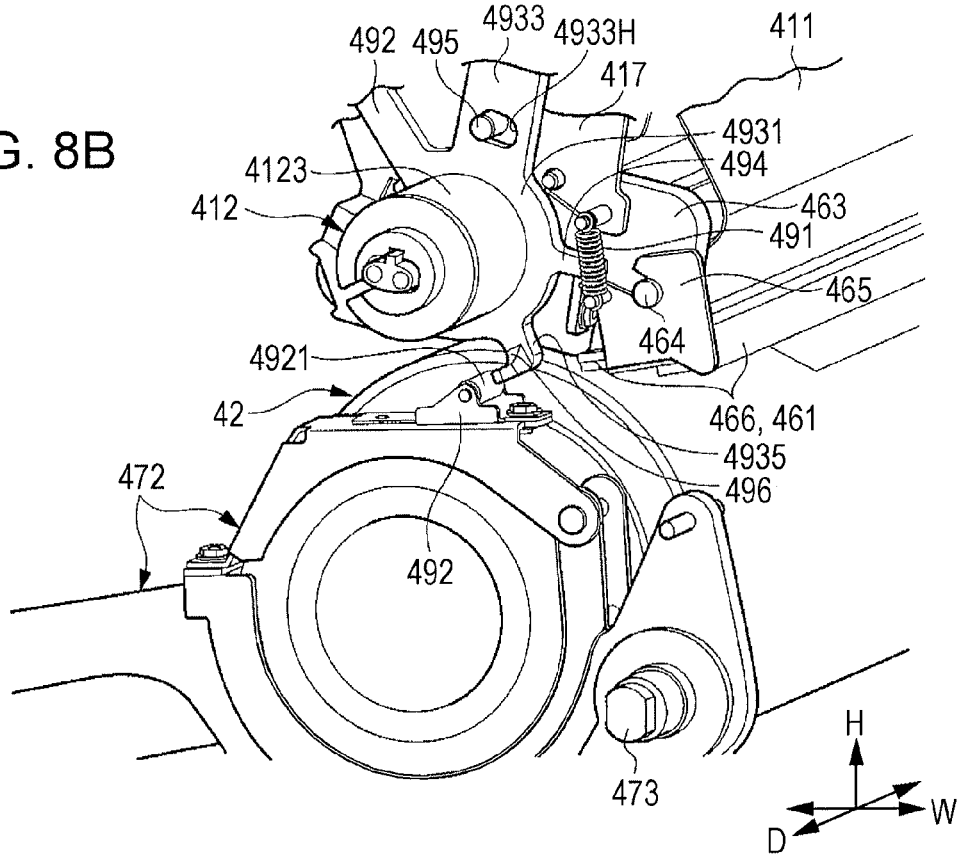

The separation pad 461 of the separation pad mechanism 46 serves as an example of a guide member. The separation pad 461 can be placed at a separating position where the distal end thereof is close to the fixing belt 411, as illustrated in FIGS. 7A and 8A, and a withdrawal position where the distal end is separate from the fixing belt 411, as illustrated in FIGS. 7B and 8B. The separation pad 461 will be specifically described below.

The separation pad mechanism 46 includes a bracket 463, a turn plate 465 supported turnably relative to the bracket 463 about a support shaft 464 extending in the apparatus depth direction, and a plate 466 fixed to the turn plate 465 and extending long in the apparatus depth direction. The bracket 463 is fixed to a module frame 417 of the fixing belt module 41.

The separation pad 461 is fixed to the plate 466 such as to be supported over the entire length thereof in the apparatus depth direction. The bracket 463, the support shaft 464, and the turn plate 465 are provided on each side in the apparatus depth direction. The plate 466 is laid between a pair of turn plates 465. With the above structure, the separation pad 461 turns about the support shaft 464 together with the plate 466 so that its position is switched between the separating position and the withdrawal position.

The fixing device 40 further includes an operative associating mechanism 49 serving as an example of a moving unit that operatively associates switching between the separating position and the withdrawal position of the separation pad 461 with switching between the contact position and the separate position of the pressurizing roller 42. The operative associating mechanism 49 of the exemplary embodiment biases the separation pad 461 to the separating position with biasing force, and moves the separation pad 461 from the separating position to the withdrawal position along with movement of the pressurizing roller 42 from the contact position to the separate position. The operative associating mechanism 49 will be specifically described below.

The operative associating mechanism 49 includes an extension coil spring 491 that is caught at one end by the module frame 417 (bracket 463) and at the other end by the turn plate 465. The separation pad 461 is biased to the separating position by being pressed against an unillustrated stopper by biasing force of the extension coil spring 491.

The operative associating mechanism 49 further includes a restricting portion 492 serving as an example of a regulating member that operates with the operation of the switch mechanism 48 for switching the position of the pressurizing roller 42, and an intermediate member 493 that transmits the operation of the restricting portion 492 to the turn plate 465. The restricting portion 492 is fixed to an upper end of the movable frame 472.

Figure 9:
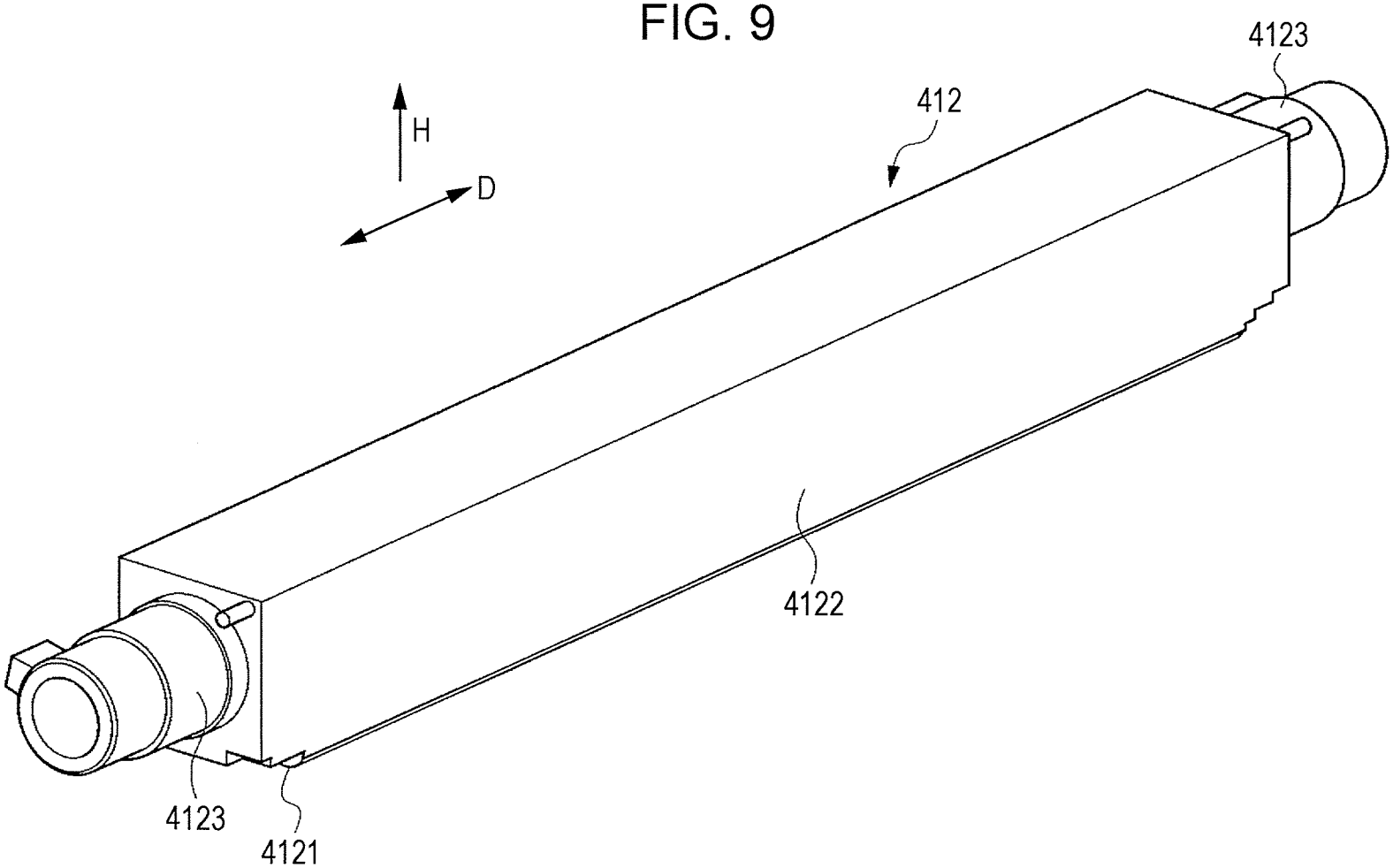
FIG. 9 is a perspective view of a pad member that forms the fixing device of the exemplary embodiment.

The intermediate member 493 is supported turnably relative to the pad member 412. More specifically, as illustrated in FIG. 9, the pad member 412 includes cylindrical portions 4123 protruding from the body portion 4122 toward both sides in the apparatus depth direction. Each of the cylindrical portions 4123 turnably supports the corresponding intermediate member 493 on an outer peripheral surface thereof.

The intermediate member 493 includes a ring-shaped body portion 4931 turnably supported by the corresponding cylindrical portion 4123, and four arms 4932 to 4935 extending outward from the body portion 4931 in the radial direction. At least one of an outer peripheral portion of the cylindrical portion 4123 of the pad member 412 and an inner peripheral portion of the body portion 4931 of the intermediate member 493 is formed as a slide bearing made of a porous material impregnated with lubricant oil. As the porous material that forms the slide bearing, for example, sintered metal can be used. The slide bearing may be formed integrally with the pad member 412 or the intermediate member 493, or may be separately formed and attached thereto. For example, the entire intermediate member 493 may be formed of a porous material impregnated with lubricant oil.

The operative associating mechanism 49 further includes an extension coil spring 494 serving as an example of a biasing member, and a stopper member 495. The extension coil spring 494 is caught at one end by the module frame 417 and at the other end by the arm 4932, and biases the intermediate member 493 in a direction of arrow C in FIGS. 7A and 7B. The stopper member 495 is fixed to the bracket 463, and is located in a slot 4933H provided in the arm 4933. By contact with a rim of the slot 4933H of the arm 4033, the stopper member 495 restricts the intermediate member 493 from turning in the direction of arrow C beyond the withdrawal position.

The arm 4934 contacts with the turn plate 465 along with turn of the intermediate member 493 in the direction of arrow C, and further turns in the direction of arrow C in this contact state, thereby turning the turn plate 465 in a direction of arrow D in FIGS. 7A and 7B. This turn of the turn plate 465 in the direction of arrow D moves the separation pad 461 from the separating position to the withdrawal position. That is, a turn moment Md in the direction of arrow D more than a turn moment Me of the extension coil spring 491 in a direction (arrow E) opposite the direction of arrow D acts on the turn plate 465 from the extension coil spring 494 via the intermediate member 493 (Me<Md).

A restricted portion 496 protrudes forward in the apparatus depth direction from a distal end of the arm 4935. The restricted portion 496 is in contact with an outer ring of a bearing 4921 with an inner ring supported by the restricting portion 492 in a state in which the pressurizing roller 42 is at the contact position. As illustrated in FIG. 7A, when the bearing 4921 of the restricting portion 492 contacts with the restricted portion 496, the intermediate member 493 is restricted from turning from the separating position in the direction of arrow C. In this state, the stopper member 495 is located in the center of the slot 4933H, and is separate from the rim of the slot 4933H. That is, the intermediate member 493 can turn within a range from a turn position where the restricted portion 496 is in contact with the bearing 4921 of the restricting portion 492 (FIG. 7A) to a turn position where the stopper member 495 is in contact with the rim of the slot 4933H of the arm 4933 (FIG. 7B).

The restricted portion 496 of the intermediate member 493 comes out of contact with the bearing 4921 of the restricting portion 492 along with movement of the pressurizing roller 42 from the contact position to the separate position, and the intermediate member 493 is turned in the direction of arrow C by the biasing force of the extension coil spring 494. As a result, the separation pad 461 is moved from the separating position of FIG. 7A to the withdrawal position of FIG. 7B. The restricted portion 496 of the intermediate member 493 serves to receive a turn restricting load from the restricting portion 492 provided on the side of the pressurizing roller 42.

The intermediate member 493 supported by the pad member 412 for supporting the fixing belt 411 from the inner peripheral side is located on an inner side of the circulation path of the fixing belt 411 as a whole, as viewed in the apparatus depth direction (in the direction of rotation axis of the pressurizing roller 42). For this reason, the bearing 4921 of the restricting portion 492 in contact with the intermediate member 493 is located on the inner side of the circulation path of the fixing belt 411 in a state in which the pressurizing roller 42 is at the contact position, as viewed in the apparatus depth direction.

While the operative associating mechanism 49 includes the intermediate member 493 turnably supported by the pad member 412 in the above-described exemplary embodiment, the structure of the operative associating mechanism 49 is not limited thereto. For example, the operation of the switch mechanism 48 may be directly transmitted to the separation pad mechanism 46 without using any intermediate member. Alternatively, for example, the operative associating mechanism 49 may include other intermediate members such as a link mechanism and a crank mechanism.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an endless belt;

a fixing rotating body that contacts with and separates from the belt and fixes, in cooperation with the belt, an image formed on a recording medium nipped between the fixing rotating body and the belt while rotating in contact with the belt;

a support member provided on an inner side of the belt so that the belt slides on the support member during circulation, the support member supporting a load provided when the fixing rotating body is in contact with the belt so as to form a nip portion where the recording medium is nipped between the belt and the fixing rotating body;

a guide member opposing an outer peripheral portion of the belt on a downstream side of the nip portion in a circulating direction of the belt, the guide member guiding the recording medium to separate the recording medium from the belt after the recording medium passes through the nip portion; and a moving unit that moves the guide member away from the belt along with separation of the fixing rotating body from the belt, wherein the moving unit includes an intermediate member that is supported movably relative to the support member and is moved relative to the support member along with separation of the fixing rotating body from the belt so as to move the guide member away from the belt, and a biasing member that biases the intermediate member relative to the support member so as to move the guide member away from the belt.

2. The fixing device according to claim 1, wherein the moving unit further includes:

a restricting member provided at the fixing rotating body, the restricting member restricting the intermediate member from being moved by biasing force of the biasing member when the fixing rotating body is at a position in contact with the belt, and allowing the intermediate member to be moved relative to the support member by the biasing force of the biasing member along with separation of the fixing rotating body from the belt.

3. The fixing device according to claim 1, wherein an assembly including the belt and the support member is detachably mounted in a device body, and wherein a portion of the intermediate member that receives the load from the fixing rotating body is located in an inner side of the belt, as viewed in an axial direction of the fixing rotating body.

4. The fixing device according to claim 2, wherein an assembly including the belt and the support member is detachably mounted in a device body, and wherein a portion of the intermediate member that receives the load from the fixing rotating body is located in an inner side of the belt, as viewed in an axial direction of the fixing rotating body.

5. The fixing device according to claim 1, wherein at least a portion of the intermediate member that slides on the support member along with the relative movement and a portion of the support member on which the intermediate member slides along with the relative movement is formed of a porous material impregnated with lubricant oil.

6. An image forming apparatus, comprising:

a toner-image forming unit that forms a toner image on a recording medium;

a transfer device that transfers the toner image formed by the toner-image forming unit onto the recording medium; and the fixing device according to claim 1, the fixing device fixing the toner image transferred on the recoding medium.

7. The fixing device according to claim 2, wherein the restricting member comprises a bearing that contacts with a restricted portion of the intermediate member, and wherein the restricted portion of the intermediate member comes out of contact with the bearing of the restricting member along with a movement of a pressurizing roller from a contact position to a separate position.

* * * * *